US007503807B2

(12) United States Patent
Martin et al.

(10) Patent No.: US 7,503,807 B2
(45) Date of Patent: Mar. 17, 2009

(54) ELECTRICAL CONNECTOR ADAPTER AND METHOD FOR MAKING

(75) Inventors: Galen M. Martin, Camp Hill, PA (US); Keith Richard Foltz, Duncannon, PA (US); David Michael Revak, Kernersville, NC (US); Alan Jay Amazon, Kernersville, NC (US); Jimmy Glenn Grubbs, Walkertown, NC (US); David A. Swartwood, Randleman, NC (US); Michael F. Laub, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/500,773

(22) Filed: Aug. 8, 2006

(65) Prior Publication Data

US 2007/0037452 A1 Feb. 15, 2007

Related U.S. Application Data

(60) Provisional application No. 60/706,825, filed on Aug. 9, 2005.

(51) Int. Cl.
*H01R 25/00* (2006.01)

(52) U.S. Cl. ..... 439/638; 439/668

(58) Field of Classification Search ..... 439/638, 439/668, 669

See application file for complete search history.

(56) References Cited

U.S. PATENT DOCUMENTS 3,452,149 A * 6/1969 Rinaldi ..... 174/261
4,943,244 A * 7/1990 Teck et al. ..... 439/567
4,983,127 A * 1/1991 Kawai et al. ..... 439/79
5,022,871 A * 6/1991 Sekiguchi ..... 439/609
5,178,562 A * 1/1993 Ermini ..... 439/609
5,362,244 A * 11/1994 Hanson et al. ..... 439/82
5,564,945 A * 10/1996 Domingos et al. ..... 439/567
5,984,727 A * 11/1999 Wu et al. ..... 439/607
6,183,295 B1 * 2/2001 Hashimoto ..... 439/573
6,471,546 B1 * 10/2002 Zhu et al. ..... 439/607
6,835,080 B1 * 12/2004 Chang ..... 439/188
7,128,591 B2 * 10/2006 Tsai ..... 439/188
7,137,851 B2 * 11/2006 Xue et al. ..... 439/668

FOREIGN PATENT DOCUMENTS

DE 197 41 466 4/1999

OTHER PUBLICATIONS

Ford Motor Co., Drawing No. 357T-19A164-AB, Mar. 22, 2002, 1 pg.
Lumberg Connect—Customized Solutions, Lumberg Catalog, 12 pgs.
European Patent Office Search Report, EP 06 11 8688, Nov. 9, 2006.

* cited by examiner

*Primary Examiner*—Thanh-Tam T Le

(57) ABSTRACT

An electrical connector adapter (40) is disclosed for electrically interconnecting a portable electronic component such as an MP3 player, CD player, or other portable device with sound or other equipment in a vehicle. The adapter (40) includes a one-piece insulating housing (60) having a system mating end (42) for interconnecting to a vehicle's electrical system and a component mating end (44) for interconnecting to a portable electrical component. Three electric contacts (62, 64, 68) are retained in three openings (90, 92, 94) respectively in the housing (60) and are arranged to electrically mate with a plug (54) of a portable electrical component.

10 Claims, 7 Drawing Sheets

ELECTRICAL CONNECTOR ADAPTER AND METHOD FOR MAKING

The benefits of Provisional Application No. 60/706,825, filed on Aug. 9, 2005, are hereby claimed under 35 U.S.C. 119(e).

The present invention relates to electrical connectors for electrically interconnecting electronic components and more particularly an electrical connector adapter for electrically interconnecting portable electronic components with sound or other equipment in a vehicle.

BACKGROUND OF THE INVENTION

Portable electronic devices popular with the general consumer, such as MP3 players, CD players, and other similar device with sound or video are in wide spread use. These devices are usually stand-alone in that they contain the necessary speakers and display screens to function completely independent of any other supporting systems. It is desirable to interface such portable devices with a vehicle's systems so that audio from the portable device can be played through the vehicle's sound system. However, the connectors used in the automotive industry are substantially different from the standard connectors used by these portable devices. The interface connection is accomplished be means of an electrical connector adapter mounted to a convenient panel within the vehicle for receiving a standard 3.5 mm electrical plug from the portable device. The electrical connector adapter includes a set of pin contacts that mate with an electrical connector that is interconnected with the vehicle's sound system thereby connecting the plug contacts of the portable device directly to the vehicle's sound system.

An example of such an existing electrical connector adapter is shown In FIGS. 1, 2, and 3 where the connector adapter is indicated as 10. The adapter 10 includes a two piece insulating housing consisting of a main housing 12 and a cover plate 14 which is bonded to the end of the main housing 12. A machined metal collar 16 is fitted into a hole 18 in the cover plate 14 and held in place by either an interference fit or bonding. As best seen in the cross-sectional view of FIG. 3 three electrical contacts 20, 22, and 24 are arranged within the main housing 12 in respective positions. The electrical contacts terminate at their other ends in contact pins 26. A hole is formed axially in the collar 16 for receiving an electrical plug from a portable audio device and guiding the plug into mating contact with the three electrical contacts 20, 22, and 24. The contact pins 26 extend into a cavity 28 in the end of the main housing 12 opposite the collar 16 for receiving an electrical connector, not show, which is interconnected with a vehicle's sound system. The two piece insulating housing and the machined collar result in a durable product but are relatively expensive to manufacture. This is due to the separate parts that must be fabricated, inventoried, and assembled and the machining operation that is necessary to make the collar.

Additionally, the three electrical contacts 20, 22, and 24 are typically manufactured by stamping and forming each different contact on a separate carrier strip, resulting in three carrier strips of contacts. The three different carrier strips may be wound onto respective reels for later use or the three carrier strips can be immediately fed to a work station where one contact is severed from each respective carrier strip and inserted into the main housing 12 prior to attaching the cover plate 14. Alternatively, instead of winding the carrier strips onto reels, the contacts may be severed from all three of the carrier strips and saved in bulk form for later insertion into the main housing. Either method requires handling three different carrier strips and possibly three reels, or individual contacts in bulk form requiring specialized equipment to automate the insertion process. Such processes are cumbersome, expensive to carry out and prone to equipment malfunction.

What is needed is an electrical connector adapter having fewer parts that are easily manufactured and easily and accurately assembled into an adapter of robust design.

SUMMARY OF THE INVENTION

An electrical connector adapter is provided having a system mating end for interconnecting to a vehicle's electrical system and a component mating end for interconnecting to a standard plug of an electrical component. The electrical connector adapter includes a one piece insulating housing and one or more electrical contacts in the housing. A collar of unitary construction covers a portion of the component mating end and includes an opening for receiving an electrical component plug. The collar includes a flange with a projection extending outwardly forming an interior cavity that receives a boss formed on the component mating end of the housing for aligning the opening in the collar with the electrical contacts. A cylindrically shaped wall, integral to the collar, is coaxial with the opening and extends into the cavity. The electrical contacts are arranged in the housing so that they extend from the system mating end to the component mating end and are aligned with the opening in the collar.

Where the electrical connector adapter includes multiple electrical contacts, the contacts are fabricated in groups of adjacent contacts positioned on the same carrier strip, each group having contacts for a single insulating housing. The groups of electrical contacts are stamped and formed in a series of progressive operations, gripped by holding tooling, then severed as a group from the carrier strip. The contacts are then aligned laterally with corresponding contact receiving apertures in the insulating housing, inserted into their respective apertures and released. Then the collar is attached to the insulating housing. All of these operations are performed in a continuous cycle of concurrent, progressive operations.

An embodiment of the invention will now be described by way of example with reference to the following drawings.

DESCRIPTION OF AN EMBODIMENT OF THE INVENTION

Figure 1:
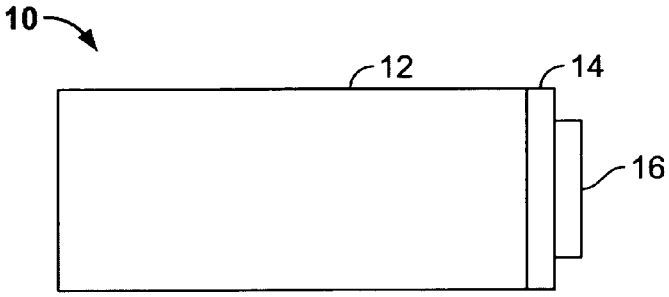
FIG. 1 (Prior Art)
FIG. 1 is a plan view of an electrical connector adapter of known construction.
Figure 2:
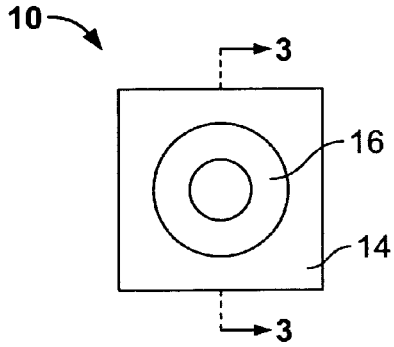
FIG. 2 (Prior Art)
FIG. 2 is an end view of the adapter shown in FIG. 1.
Figure 3:
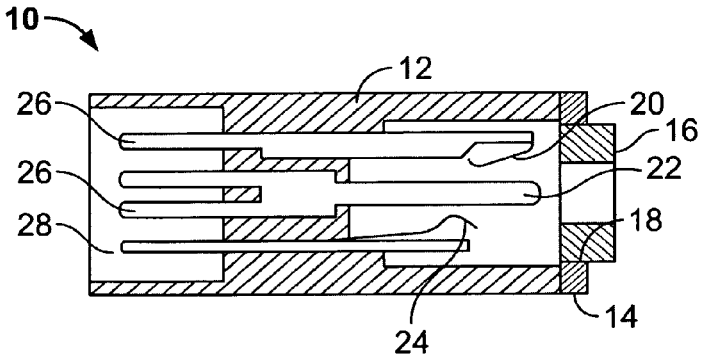
FIG. 3 (Prior Art)
FIG. 3 is a cross-sectional view taken along the lines 3-3 in FIG. 2.
Figure 4:
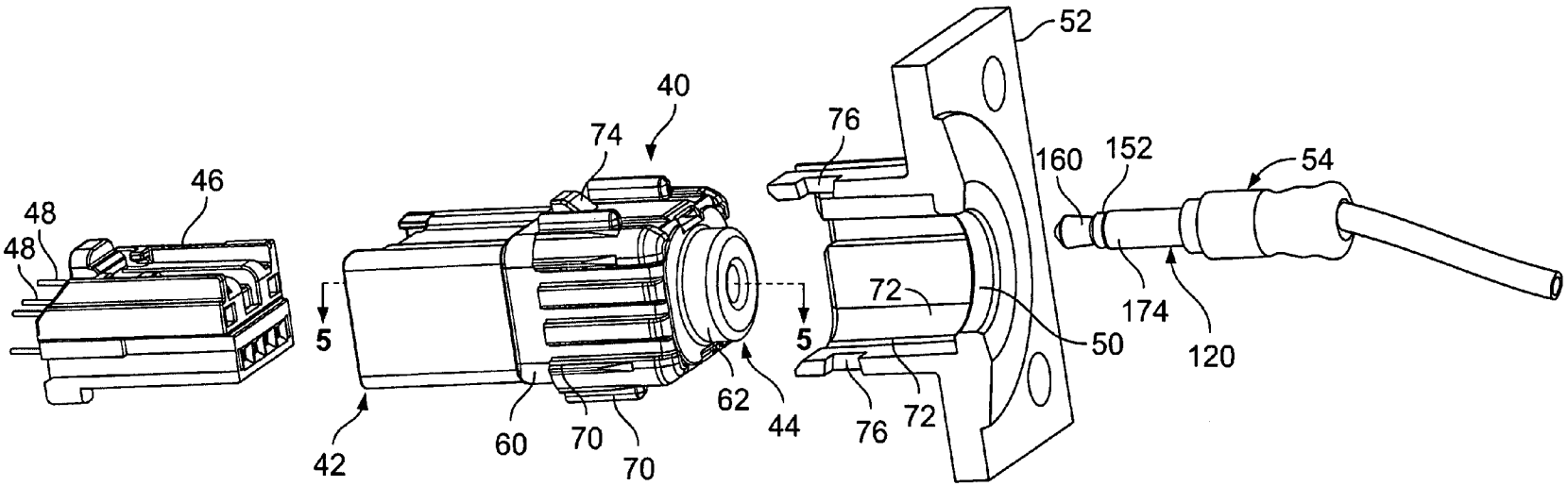
FIG. 4 is an exploded view showing the electrical connector adapter of the present invention in an operating environment.

There is shown in the exploded view of FIG. 4 an electrical connector adapter 40, according to the invention disclosed herein. The electrical connector adapter includes a system mating end 42 for interconnecting to a vehicle's audio system and a component mating end 44 for interconnecting to a portable electrical device such as an MP3 player, CD player, or other similar device. A vehicle connector 46 interconnected to a vehicle's audio system by means of the wires 48 is arranged to mate with electrical contacts, not shown, in the system mating end 42 of the adapter 40. A portion of the component mating end 44 extends into an opening 50 in a panel mounting bracket 52, shown in FIG. 4, which is attached to the interior paneling of the vehicle. The panel mounting bracket 52 is positioned within the vehicle so that when the adapter 40 is installed into the panel mounting bracket 52, the component mating end 44 of the adapter 40 is conveniently available for insertion of a standard electrical component audio plug 54, such as a 3.5 mm plug, by an occupant of the vehicle. When the plug 54 is fully inserted into the adapter 40 it engages and mates with electrical contacts in the adapter 40 which extend to the system mating end 42 of the adapter 40, which in turn mates with the vehicle connector 46, as will be explained in more detail below.

Figure 5:
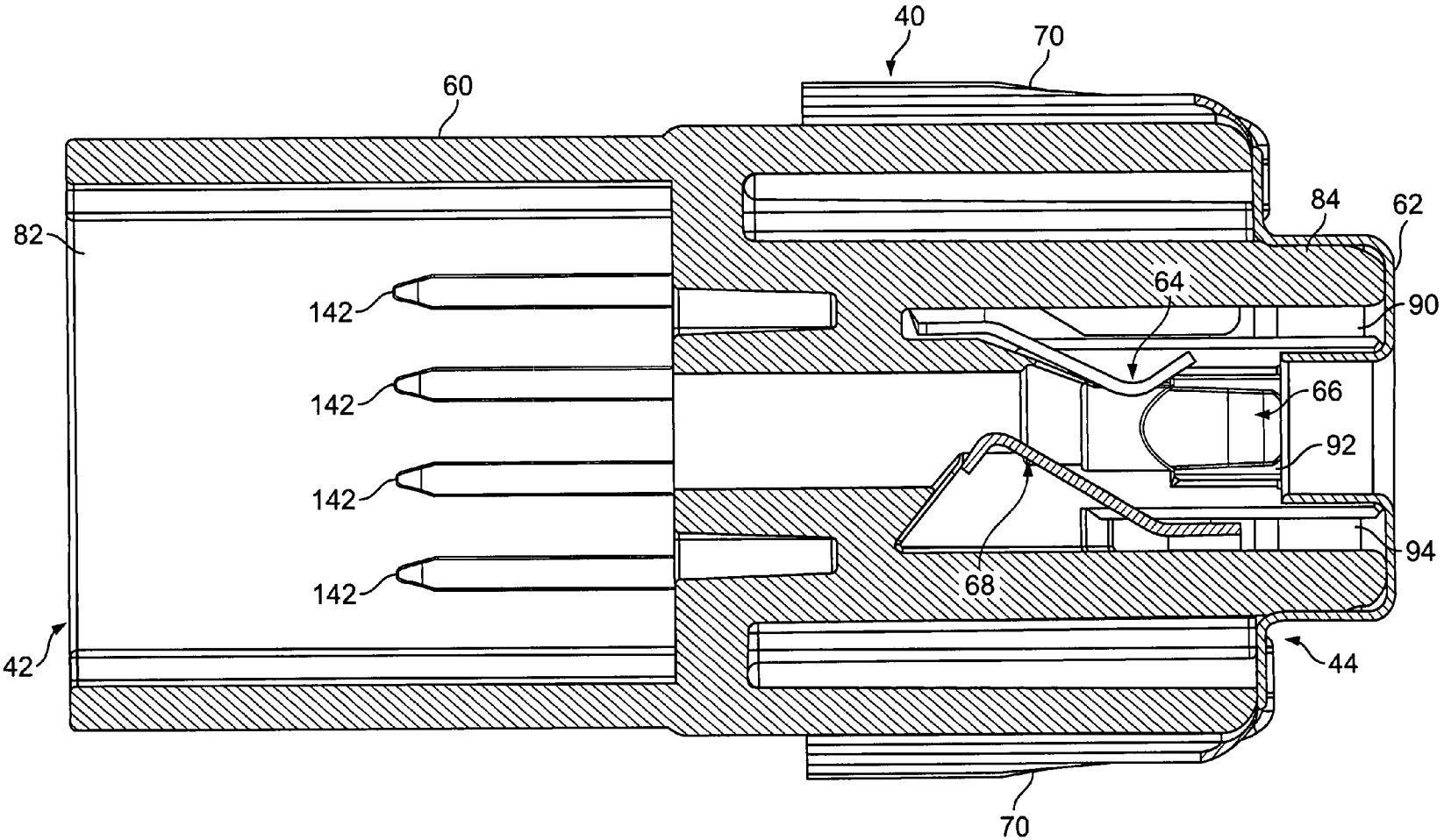
FIG. 5 is a cross-sectional view taken along the lines 5-5 in FIG. 4.
Figure 6:
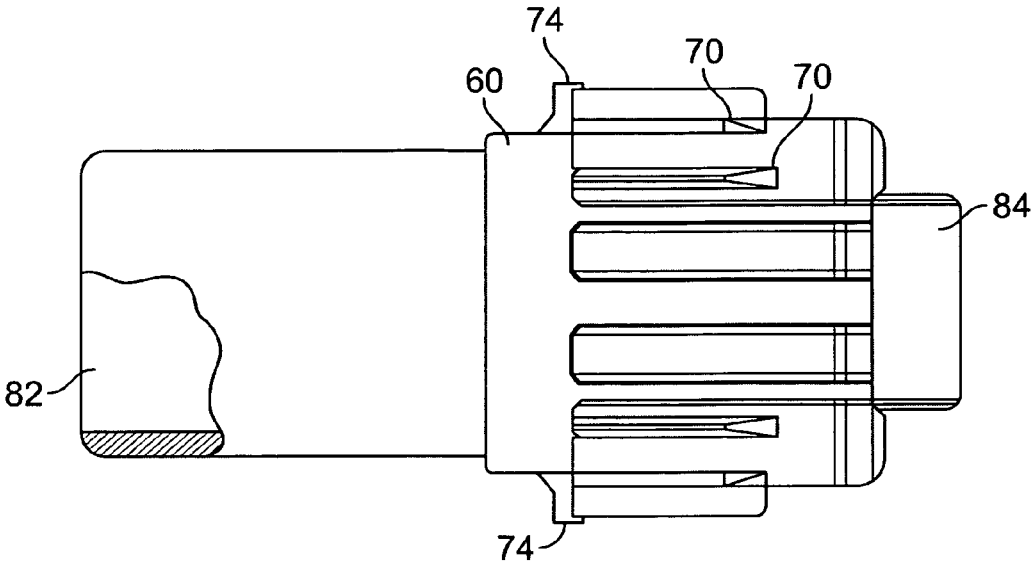
FIG. 6 is a plan view of the one-piece insulating housing shown in FIG. 4.
Figure 7:
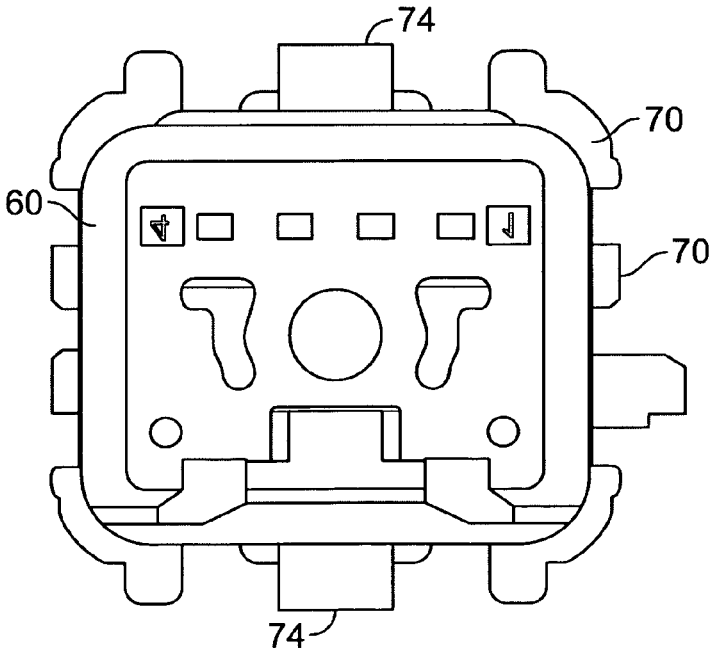
FIG. 7 is a left end view of the housing shown in FIG. 6.
Figure 8:
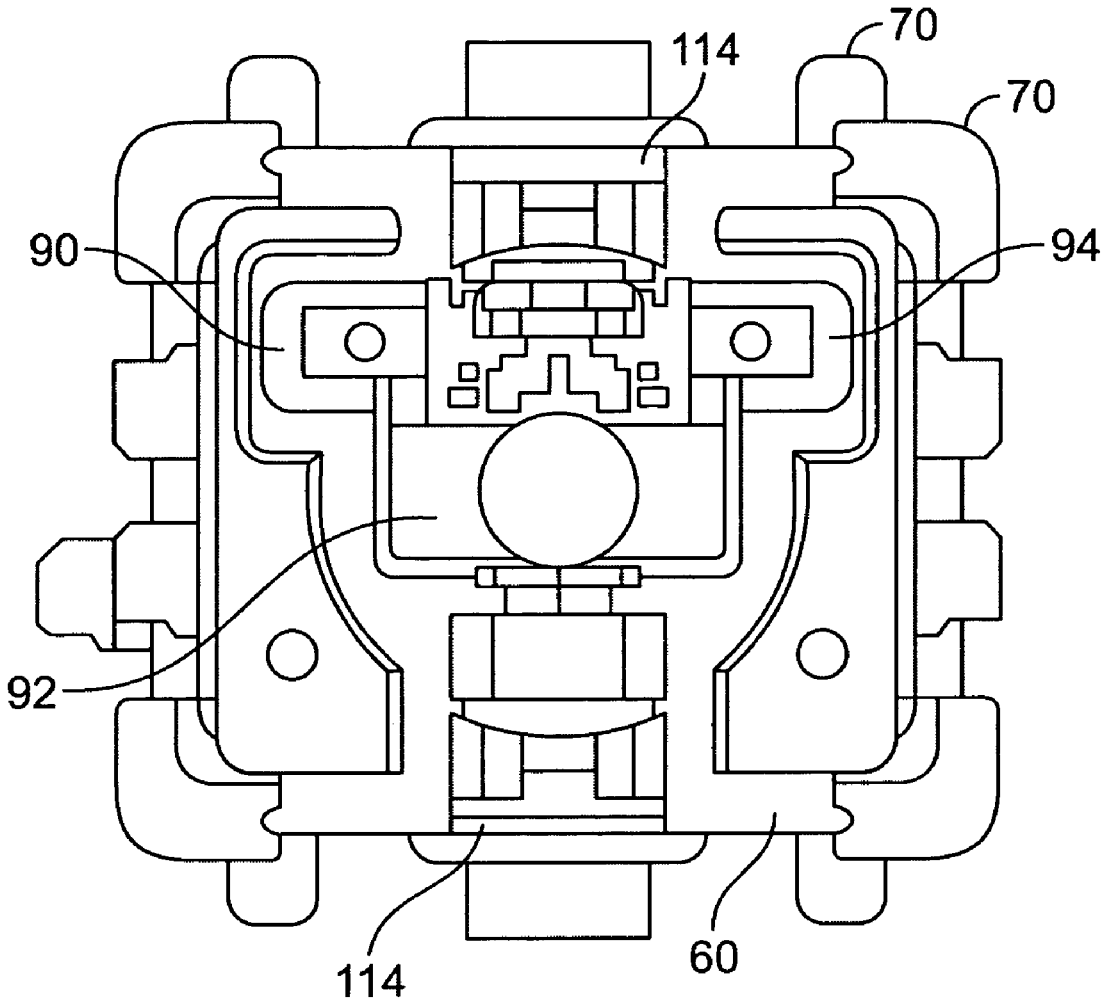
FIG. 8 is a right end view of the housing shown in FIG. 6.

As best seen in FIG. 5 the electrical connector adapter 40 includes a one-piece insulating housing 60, a collar 62 covering a portion of the component mating end 44, and three electrical contacts 64, 66, and 68. As shown in FIG. 5, the electrical contacts 64, 66, and 68 are arranged so that one end of the contacts electrically engages the plug 54 at the component mating end 44 of the adapter 40 and, the other end of the contacts electrically engages the vehicle connector 46 at the system mating end 42 of the adapter 40. The insulating housing 60, shown in FIGS. 5 through 8, is constructed as a single piece and includes mounting features 70, such as ribs, on an outer surface that engage mating features 72, such as grooves, on the mounting bracket 52, shown in FIG. 4, for locating and properly aligning the housing when assembled to the bracket. Retention features 74, such as tabs, are positioned on opposite sides of the housing 60 and engage corresponding notches 76 in the bracket 52, shown in FIG. 4, for retaining the adapter 40 within the bracket. By way of example, the housing 60 may be molded from an insulting plastic such as Polyester and Polycarbonate Blend with 30% Glass Fiber Fill which is manufactured by the General Electric Co. It will be understood that other suitable insulating materials may be advantageously utilized in the practice of the present invention. A cavity 82, as best seen in FIG. 6, is formed in an end of the housing 60 and is sized to matingly receive the vehicle connector 46. A somewhat cylindrically-shaped boss 84 extends from an end of the housing 60 opposite the end having the cavity 82 for a purpose that will be explained. As shown in FIGS. 5 and 8, there are three contact receiving openings 90, 92, and 94 formed in the housing 60 and include features for retaining the contacts within the housing.

Figure 9:
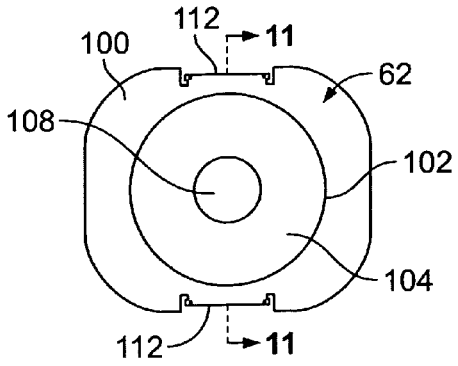
FIG. 9 is a plan view of the collar shown in FIG. 4.
Figure 10:
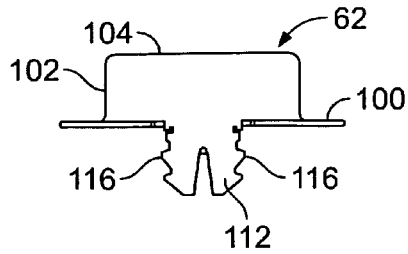
FIG. 10 is a side view of the collar shown in FIG. 9.
Figure 11:
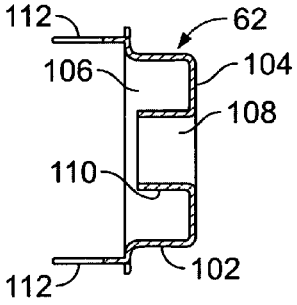
FIG. 11 is a cross-sectional view taken along the lines 11-11 in FIG. 9.

The collar 62, as shown in FIGS. 9, 10, and 11, is of unitary constructed and is stamped and drawn from a flat sheet metal blank. The collar 62 includes a flange 100 having a projection 102 extending outwardly from the flange and terminating in an approximate planar surface 104. The projection 102 forms a cavity 106, as best seen in FIG. 11, which is sized to receive the boss 84 of the one-piece insulating housing 60. As shown in FIG. 11, an opening 108 is formed in the planar surface 104 and a cylindrically shaped wall 110, coaxial with the opening 108, extends from the planar surface inwardly into the cavity 106. Two locking tabs 112 extend at right angles to the flange 100 in a direction opposite that of the projection 102. The locking tabs 112 have barbs 116 that are arranged to lockingly engage corresponding openings 114 in the housing 60 shown in FIG. 8. The opening 108 is sized to receive a shank 120 of the component plug 54 shown in FIG. 4.

Figure 12:
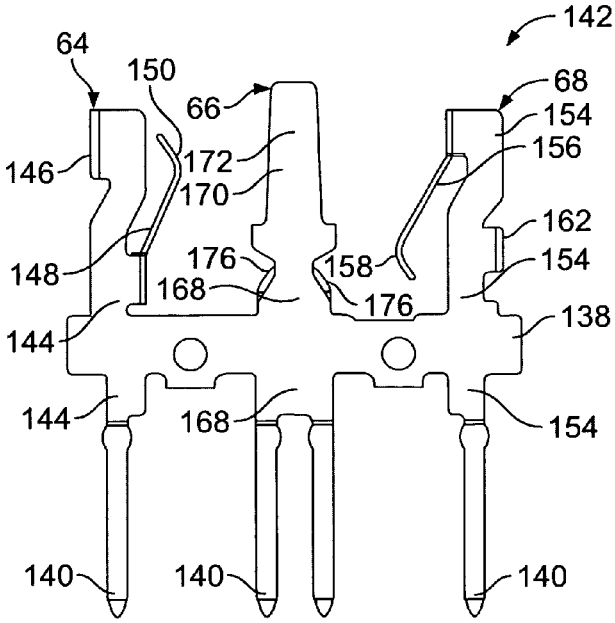
FIG. 12 is a plan view of a group of electrical contacts included in the connector adapter of FIG. 5 shown prior to their separation.
Figure 13:
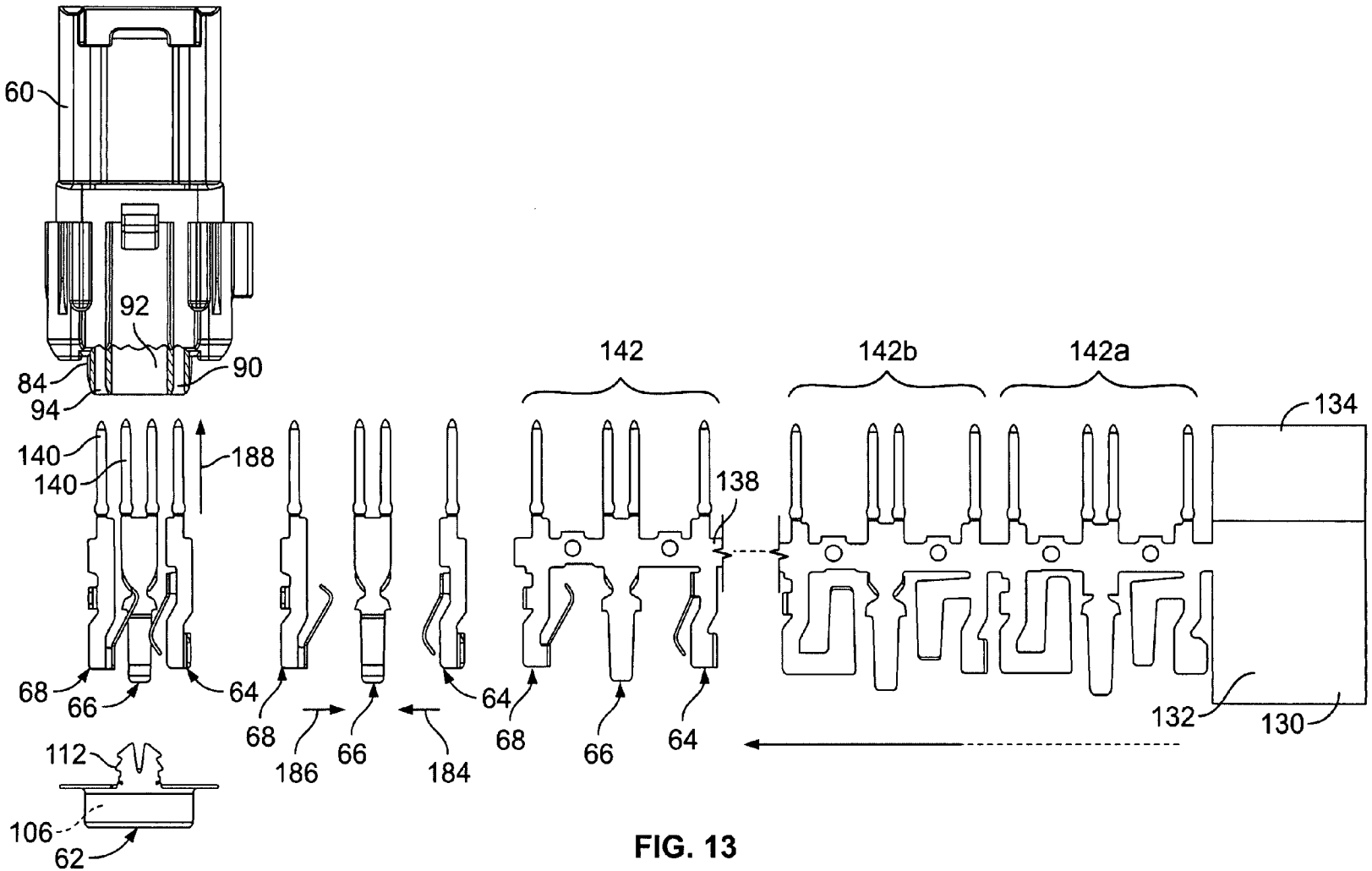
FIG. 13 is a schematic representation of the assembly process for the electrical connector adapter shown in FIG. 4.

The electrical contacts 64, 66, and 68, as best seen in FIG. 12, are stamped and formed from a blank strip 130 of material shown in FIG. 13. In the exemplary embodiment, the blank strip 130, shown in FIG. 13, includes a relatively thin portion 132 having a thickness about 0.013 inch and a thicker portion 134 having a thickness about 0.026 inch. Both portions extend for the strip's entire length. This dual thickness material is known as "Skived" material and, in the present example, is C510 phosphorus bronze, temper 8. This material is available for purchase from Olin Brass Corporation of East Alton, Ill., and is available from other suppliers. It will be understood that other suitable contact materials may be advantageously utilized in the practice of the present invention as well as materials of thicknesses that differ from those disclosed herein. The electrical contacts 64, 66, and 68, shown in FIG. 12, are stamped and formed in the usual manner, except as set forth below, so that the contacts are interconnected by a carrier strip 138. The contacts 64, 66, and 68 include pins 140 formed from the thick portion 134 and are sized to mate with the vehicle connector 46. Note that, in the exemplary embodiment, the contacts 64 and 68 each have only one pin 140 while the contact 66 has two pins to meet the requirements of a specific vehicle's wiring system. It will be understood that each of the contacts 64, 66, and 68 may have one or more pins 140 to meet such requirements.

As shown in FIG. 12, the three contacts 64, 66, and 68 are stamped and formed from the blank strip 130 in a group 142 of contacts resulting in the three individual contacts being adjacent on the same carrier strip 138. This grouping of the three contacts is advantageous in that a single strip of contacts provides all three of the contacts 64, 66, and 68 to the assembly tooling for insertion into the housing, as will be explained below. As best seen in FIG. 12, the individual contact 64 includes a flat body 144 extending from the pin 140, upwardly through the carrier strip 138 and terminating with a retaining tab 146 that is formed about 90 degrees to the body as shown. The retaining tab 146 engages a feature in the opening 90, FIG. 5, to secure the contact in place in the housing 60. A spring beam 148 extends at right angles to the body 144 and includes a contacting surface 150 for electrically engaging a first contact 152 on the component plug 54 shown in FIG. 4. As shown in FIG. 12, the contact 68 includes a flat body 154 extending from the pin 140, upwardly through the carrier strip 138 and terminating in a spring beam 156. The spring beam 156 extends at right angles to the body 154 and includes a contacting surface 158 for electrically engaging a second contact 160 on the component plug 54 shown in FIG. 4. A retaining tab 162 is formed at right angles to the body 154 opposite the contacting surface 158. The retaining tab 162 engages a feature in the opening 94, FIG. 5, to secure the contact in place in the housing 60. As shown in FIG. 12, the contact 66 includes a flat body 168 extending from the two pins 140, upwardly through the carrier strip 138 and terminating in a spring beam 170. The spring beam 170 extends outwardly from the body 168. The spring beam 170 includes a contacting surface 172 for electrically engaging a third contact 174 on the component plug 54 shown in FIG. 4. Two retaining tabs 176 are formed at right angles to the body 168 on opposite sides thereof. The retaining tabs 176 engage features in the opening 92 to secure the contact in place in the housing 60.

A preferred method of manufacturing the electrical connector adapter 40 includes manufacturing the three contacts 64, 66, and 68 in groups 142 of adjacent contacts formed from and attached to a single strip 130 of material. This is schematically illustrated in FIG. 13. There, the blank strip 130 of material is fed into stamping and forming tooling, not shown, that includes a series of progressive stamping and forming stations, in a manner that is well known in the art. The contacts 64, 66, and 68 are gradually formed as they progress through the tooling, in the usual manner, except that the three contacts 64, 66, and 68 are formed adjacent each other thereby forming a group of contacts. By way if example, two partially formed groups of contacts are indicated as group 142*a* and group 142*b* in FIG. 13. Each group of contacts 64, 66, and 68 progresses through the tooling until it is fully formed as indicated at 142. Note that for some contacts, as is well known in the industry, the stamping and forming operation may be interrupted for plating parts of the contacts and then resumed. The three contacts 64, 66, and 68 are then individually retained by grippers, not shown, and then severed from the carrier strip 138. The severed contacts 64 and 68 are then moved in the direction of the arrows 184 and 186, respectively, toward the severed contact 66 so that they are in alignment with the contact receiving openings 90, 92, and 94 of a previously positioned housing 60. In practice, the direction that each contact, or contact group, is moved may vary as long as the three contacts are brought into insertion alignment with their respective contact receiving openings in the housing. That is, for example, the contacts 64 and 66 may be moved toward the contact 68, or the contacts 66 and 68 may be moved toward the contact 64 to achieve the desired alignment. The three contacts 64, 66, and 68 are then moved in the direction of the arrow 188 and fully inserted into their respective openings 90, 92, and 94 where their respective retaining tabs lockingly engage the retaining features in the housing 60. As the contacts begin to enter their respective openings in the housing the grippers release them so that they can be fully inserted in the usual manner. The collar 62 is then brought into axial alignment with the housing 60, as shown in FIG. 13, and moved in the direction of the arrow 188 so that the boss 84 of the housing enters the cavity 106 of the collar, thereby automatically assuring alignment of the collar and the housing. The locking tabs 112 fully enter and lockingly engage the openings 114, retaining the collar to the housing. The completed adapter 40 is then ejected from the tooling and another housing 60 is moved into position and the process repeated. As noted above, the stamping and forming operation may be interrupted for plating parts of the contacts, it may also be interrupted at any stage of completion and the product stored for later use.

While a specific example of an embodiment of the present invention has been described, it will be understood by those skilled in the art that variations in the physical structure and composition of material of the housing 60, contacts 64, 66, and 68, and the collar 62, may be made without departing from the spirit and scope of the present invention as set forth in the appended claims. Such variations may include different shapes for the one-piece housing, the collar, and the contacts as well as different contact material thicknesses, and different positions for the contacts within the one-piece housing.

An important advantage of the adapter of the present invention is that there is only a single housing part, a collar, and three contacts resulting in fewer parts compared to prior art adapters. This results in lower costs for maintaining parts inventories and handling parts prior to assembly. Additionally, the simplicity of a one-piece housing eliminates the steps required to assemble prior art multi-part housings and associated assembly errors that may occasionally occur. Another important advantage of the present invention is that the collar is stamped and formed from a sheet metal blank which is a relatively inexpensive process compared to machining the collar of the prior art adapter. And the collar of the present invention has a flange that covers the openings in the housing into which the electrical contacts were inserted without the need for another cover part as is required by the prior art adapter. The housing of the present invention includes a central projection that engages a cavity in the collar for automatically assuring the alignment of the two parts during assembly thereby eliminating potential alignment errors. Another important advantage of the present invention is the cost reduction and ease of assembly made possible by stamping and forming all of the contacts for a single adapter in a group of adjacent contacts on the same carrier strip. Having only a single strip of contacts containing all the contacts necessary to complete the adapter reduces the complexity of the insertion tooling resulting in a more efficient assembly operation.

The invention claimed is:

1. An electrical connector adapter having a system mating end for connecting to an electrical system of a vehicle and a component mating end for connecting to an electrical component plug comprising:

(a) a one piece insulating housing;

(b) at least one electrical contact arranged in said housing extending substantially from said system mating end to said component mating end; and (c) a collar of unitary construction covering a portion of said component mating end and having an opening for receiving said plug, wherein said collar includes a projection extending in a direction away from said insulating housing and having said opening therein, said projection comprising a cavity therein, said collar further comprising a wall extending from said projection into said cavity coaxial with said opening;

wherein said at least one electrical contact is three electrical contacts for electrically connecting to three respective contacts of said electrical component plug.

2. The electrical connector adapter according to claim 1 wherein said collar includes a flange having said projection extending outwardly therefrom in the direction away from said insulating housing, said projection terminating in an approximate planar surface having said opening therein, thereby defining said cavity within said projection.

3. The electrical connector adapter according to claim 1 wherein said insulating housing includes a boss extending into said cavity for accurately aligning said opening with said at least one contact.

4. The electrical connector adapter according to claim 2 wherein said wall extends from said planar surface.

5. The electrical connector adapter according to claim 1 wherein said collar includes a tab extending in a direction opposite to that of said projection, said tab arranged to lockingly engage said insulating housing.

6. The electrical connector adapter according to claim 1 wherein said one-piece insulating housing includes at least one contact opening arranged for receiving said at least one electrical contact.

7. The electrical connector adapter according to claim 6 wherein a portion of said collar substantially covers said contact opening.

8. The electrical connector adapter according to claim 1 wherein said collar comprises a metal.

9. The electrical connector adapter according to claim 1 wherein said collar is stamped from a blank.

10. An electrical connector adapter having a system mating end for connecting to an electrical system of a vehicle and a component mating end for connecting to an electrical component plug comprising:

(a) a one piece insulating housing comprising a contact opening;

(b) an electrical contact arranged in said housing within said contact opening, said electrical contact extending substantially from said system mating end to said component mating end; and (c) a collar of unitary construction covering a portion of said component mating end and having a plug opening for receiving said plug, wherein a portion of said collar substantially covers said contact opening;

wherein said electrical contact is three electrical contacts for electrically connecting to three respective contacts of said electrical component plug.

* * * * *